US006656546B2

(12) United States Patent
Saito

(10) Patent No.: US 6,656,546 B2
(45) **Date of Patent: *Dec. 2, 2003**

(54) TRANSFER SHEET, METHOD OF MANUFACTURING THE SAME AND TRANSFER PRINTING METHOD

(75) Inventor: Hitoshi Saito, Shinjuku-Ku (JP)

(73) Assignee: Dai Nippon Printing Co., Ltd. (JP)

( * ) Notice: Subject to any disclaimer, the term of this patent is extended or adjusted under 35 U.S.C. 154(b) by 105 days.

This patent is subject to a terminal disclaimer.

(21) Appl. No.: 09/978,263

(22) Filed: Oct. 17, 2001

(65) Prior Publication Data

US 2002/0025415 A1 Feb. 28, 2002

Related U.S. Application Data

(62) Division of application No. 09/310,581, filed on May 12, 1999, now Pat. No. 6,333,295.

(30) Foreign Application Priority Data

May 14, 1998 (JP) ..... 10-131817

(51) Int. Cl.[7] ..... B41M 5/40

(52) U.S. Cl. ..... 428/32.76; 156/235; 427/152; 503/227

(58) Field of Search ..... 156/235; 428/195, 428/913, 914, 32.76; 503/227; 427/152

(56) References Cited

U.S. PATENT DOCUMENTS

| | | | | |
|---|---|---|---|---|
| 4,363,271 | A | 12/1982 | Horst | 101/181 |
| 4,496,955 | A | 1/1985 | Maeyama et al. | 346/76 PH |
| 4,551,729 | A | 11/1985 | Kubo et al. | 346/1.1 |
| 4,558,329 | A | 12/1985 | Honda | 346/76 PH |
| 4,573,059 | A | 2/1986 | Shinma et al. | 346/76 PH |
| 4,588,316 | A | 5/1986 | Everett, Jr. | 400/248 |
| 4,620,199 | A | 10/1986 | Tatsumi et al. | 346/76 PH |
| 4,642,655 | A | 2/1987 | Sparer et al. | 346/76 PH |
| 4,687,359 | A | 8/1987 | Barrus et al. | 400/218 |
| 4,771,296 | A | 9/1988 | Shimada et al. | 346/76 PH |
| 4,797,016 | A | 1/1989 | Lahr | 400/237 |

(List continued on next page.)

FOREIGN PATENT DOCUMENTS

| | | |
|---|---|---|
| EP | 0 119 275 B1 | 4/1988 |
| EP | 0 275 172 B1 | 5/1993 |
| EP | 0541513 | 5/1993 |

(List continued on next page.)

OTHER PUBLICATIONS

Patent Abstracts of Japan, vol. 96, No. 002, Feb. 29, 1996, JP 07–251541.

Patent Abstracts of Japan, vol. 018, No. 065, Feb. 3, 1994, JP 05–286212.

Patent Abstracts of Japan, vol. 014, No. 579, Dec. 25, 1990, JP 02–251483.

*Primary Examiner*—B. Hamilton Hess
(74) *Attorney, Agent, or Firm*—Parkhurst & Wendel, L.L.P.

(57) ABSTRACT

A transfer sheet comprises a base sheet, a thermal transfer layer having a plurality of YMC transfer region sets, each transfer region set having a plurality of transfer regions with functions different from each other, and identification marks formed in the YMC transfer region sets, respectively. The identification marks formed in the different YMC transfer region sets have different forms, respectively. The transfer regions are printed by using a plurality of transfer region printing cylinders, each provided with a plurality of printing plates, and the identification marks of different forms are printed by using a single identification mark printing cylinder. The respective identification marks of the YMC transfer region sets represent information about the positions of the corresponding YMC transfer region sets, respectively. The transfer regions are transferred after correcting transfer conditions on the basis of information represented by the identification marks.

6 Claims, 13 Drawing Sheets

U.S. PATENT DOCUMENTS

| | | | | |
|---|---|---|---|---|
| 4,851,861 | A | 7/1989 | Kikuchi et al. | 346/76 PH |
| 4,906,606 | A | 3/1990 | Yamauchi | 503/227 |
| 4,925,324 | A | 5/1990 | Ichisawa | 400/240.3 |
| 4,970,531 | A | 11/1990 | Shimizu et al. | 346/76 DH |
| 5,009,531 | A | 4/1991 | Koike | 400/240.3 |
| 5,037,218 | A | 8/1991 | Shimizu et al. | 400/237 |
| 5,073,053 | A | 12/1991 | Kashiwagi | 400/240.3 |
| 5,104,247 | A | 4/1992 | Ohshima | 400/240.3 |
| 5,144,331 | A | 9/1992 | Amano | 346/1.1 |
| 5,185,315 | A | 2/1993 | Sparer | 503/227 |
| 5,325,115 | A | 6/1994 | Tanahashi | 346/76 PH |
| 5,413,425 | A | 5/1995 | Park | 400/240.3 |
| 5,434,597 | A | 7/1995 | Muranaka et al. | 347/178 |
| 5,445,463 | A | 8/1995 | Paranjpe | 400/240 |
| 5,445,464 | A | 8/1995 | Asakura et al. | 400/249 |
| 5,466,075 | A | 11/1995 | Kouzai et al. | 400/240.3 |
| 5,480,237 | A | 1/1996 | Tanahashi | 400/120.02 |
| 5,501,537 | A | 3/1996 | Kohno | 400/240.4 |
| 5,567,066 | A | 10/1996 | Paranjpe | 400/249 |
| 5,728,450 | A | 3/1998 | Kouzai et al. | 428/195 |
| 5,769,549 | A | 6/1998 | Kouzai et al. | 400/240.4 |
| 5,781,219 | A | 7/1998 | Kouzai et al. | 347/178 |
| 5,786,841 | A | 7/1998 | Bobb et al. | 347/217 |

FOREIGN PATENT DOCUMENTS

| | | | |
|---|---|---|---|
| EP | 0 307 913 | B1 | 9/1993 |
| EP | 0 386 937 | B1 | 5/1994 |
| EP | 0 624 480 | A2 | 11/1994 |
| EP | 0 452 566 | B1 | 12/1994 |
| EP | 0 686 511 | A1 | 3/1995 |
| EP | 0 673 786 | A1 | 9/1995 |
| EP | 0 333 873 | B1 | 3/1996 |
| EP | 0 561 347 | B1 | 10/1996 |
| EP | 0 566 058 | B1 | 10/1996 |
| EP | 0749843 | | 12/1996 |
| EP | 0 749 843 | A2 | 12/1996 |
| EP | 0 807 530 | A1 | 11/1997 |
| FR | 2716412 | | 8/1995 |
| WO | WO 97/01444 | | 1/1997 |

TRANSFER SHEET, METHOD OF MANUFACTURING THE SAME AND TRANSFER PRINTING METHOD

This is a divisional of application Ser. No. 09/310,581, filed May 12, 1999, now U.S. Pat. No. 6,333,295.

BACKGROUND OF THE INVENTION

1. Field of the Invention

The present invention relates to a transfer sheet suitable for making ink ribbons for transfer printers, a method of manufacturing the same, and a transfer printing method.

2. Description of the Related Art

FIG. 2 is a typical view of assistance in explaining a conventional transfer sheet and a method of manufacturing the same.

A conventional transfer sheet 20 in the form of an ink ribbon (JP-B No. 6-96307) by way of example comprises a ribbon (base sheet) 21, a plurality of ink regions each of a plurality of color ink regions (yellow, magenta and cyan ink regions), (thermal transfer layers) 22 (22Y, 22M, 22C), and color lines (identification marks) 23 of colors of the color ink regions 22, extending perpendicularly to the length of the ink ribbon.

The transfer sheet 20 is manufactured by a suitable method, such as a gravure printing method, using printing cylinders 201, 202, 203 and 204 each having a circumference three times the length of the ink regions. First, a Y transfer region 22Y is printed by using the yellow (Y) printing cylinder 201, an M transfer region 22M is printed by using the magenta (M) printing cylinder 202, and a C transfer region 22C is printed by using the cyan (C) printing cylinder 203, Finally, the mark printing cylinder 204 prints the identification marks 23.

This method of manufacturing the conventional transfer sheet is not efficient because the transfer layers are printed one by one by using the Y, the M and the C printing cylinder. The efficiency of this method may be improved by using a printing cylinder provided with a plurality of transfer layer printing plates, i.e., multiple plate printing cylinder.

Transfer layers of an ink ribbon printed by using a printing cylinder provided with a plurality of transfer layer printing plates differ subtly in thickness from each other because of dimensional errors in the transfer layer printing plates. When such an ink ribbon is used for printing (transfer printing), colors appear in hues different from expected hues. When a sublimation transfer method capable of full-color image transfer is used, different pictures differ from each other in the gray hue of highlights and middle tone areas.

In general, transfer printers use a plurality of ink ribbons, such as a three-color type of ribbon (Y, M, C), a four-color type of ribbon (Y, M, C, Bk), a ribbon with a protective layer (Y, M, C, OP) or a ribbon with high density.

In a conventional transfer printer, a cassette which contains an ink ribbon, has a detection hole corresponding the ink ribbon for determining the type of the ink ribbon (JP-A No. 64-27981). When the cassette is inserted into the transfer printer, the detection hole is detected by a suitable mechanical measure. Another cassette may have a reflection mark representing the type of a contained ink ribbon, and the reflection mark is detected by a sensor for determining the type of the ink ribbon (JM-A No. 3-29367).

The third method is that a ribbon on which an ink ribbon is wound has a bar-code representing the type of the ink ribbon, and the bar-code is detected by the transfer printer.

However, the above three methods cause the increase of manufacturing costs of printers, because the printers need to be provided with particular mechanisms for detecting the hole, the reflection mark or the bar-code. In addition, the detection hole and the reflection mark should be changed in accordance with the corresponding ink ribbon, which leads cost increase.

Identification marks including information about the type of ink ribbon have been developed to solve the above problems. For example, identification marks representing colors whose number and width are changed in accordance with the type of media for determining the type of media (JP-B No. 6-96307) (JM-B No. 7-12004) (JP-A No. 9-10956).

In this case, however, the area of identification marks and the length of ink ribbon have been increased because of the increase of the number of the identification marks, and therefore the effective recording length and width of the ink ribbon have been shortened.

SUMMARY OF THE INVENTION

Accordingly, it is an object of the present invention to provide a transfer sheet capable of being manufactured at a high production efficiency and of forming a transfer-printed image of a satisfactory picture quality, a method of manufacturing the transfer sheet, and a transfer printing method.

According to a first aspect of the present invention, a transfer sheet comprises a base sheet, a thermal transfer layer having a plurality of transfer region sets, each transfer region set having a plurality of transfer regions with functions different from each other, and identification marks formed in the transfer region sets, in which the identification marks formed in the YMC transfer region sets consist of at least two different types.

The identification marks of one transfer region set may be formed by using different printing plates formed on a printing cylinder and may have different forms, respectively.

The identification marks of one transfer region set may be formed in the transfer regions, respectively, the identification marks of the transfer region set may be formed in the same form, and the identification mark formed in one of the transfer regions of the transfer region set may have a characteristic different from those of the identification marks formed in the other transfer regions of the same transfer region set.

The identification marks of one transfer region set may have the same form, and the identification marks of different transfer region sets may have different characteristics, respectively.

According to a second aspect of the present invention, a transfer sheet comprises a base sheet, a thermal transfer layer having a plurality of transfer region sets, each transfer region set having a plurality of transfer regions with functions different from each other, and identification marks formed in the transfer region sets, in which the identification marks comprises an identification mark having a plurality of parts, one part having a characteristic different from those of the other parts.

The identification marks of one transfer region set may be formed in the transfer regions, respectively, and the identification mark formed in one of the transfer regions of the transfer region set may have a characteristic different from those of the identification marks formed in the other transfer regions of the same transfer region set.

According to a third aspect of the present invention, a method of manufacturing a transfer sheet comprising a base sheet, a thermal transfer layer having a plurality of transfer region sets, each transfer region set having a plurality of transfer regions with functions different from each other, and identification marks formed in the transfer region sets comprises the steps of forming the thermal transfer layer having the plurality of transfer region sets on the base sheet by using a plurality of transfer region printing cylinders each provided with a plurality of printing plates for printing the transfer regions of different functions, and forming the different identification marks in the transfer region sets.

The identification marks of one transfer region set may be formed by the different printing plates mounted on the same printing cylinder and may have different forms, respectively.

The identification marks of one transfer region set may be, for each transfer region, formed by the different printing plates mounted on the same printing cylinder in the transfer regions, respectively, the identification marks of the transfer region set may have the same form, and the identification mark of one of the transfer regions of the transfer region set has a characteristic different from those for the identification marks of the other transfer regions of the same transfer region set.

The identification marks of one transfer region set may be formed in the same form by the different printing plates mounted on the same printing cylinder, and the transfer region sets may differ from each other in the characteristics of the identification marks.

A transfer printing method using a transfer sheet comprising a base sheet, a thermal transfer layer having a plurality of transfer region sets, each transfer region set having a plurality of transfer regions with functions different from each other, and identification marks formed in the transfer region sets comprises the steps of recording information in the identification marks of the transfer region sets, reading the identification marks of the transfer region sets, correcting transfer conditions on the basis of the information represented by the identification marks, and transferring the transfer regions.

BRIEF DESCRIPTION OF THE DRAWINGS

The above and other objects, features and advantages of the present invention will become more apparent from the following description taken in connection with the accompanying drawings, in which:

FIGS. 7(A), 7(B) and 7(*c*) are views of an identification mark formed on a transfer sheet and modifications thereof;

DESCRIPTION OF THE PREFERRED EMBODIMENTS

First Embodiment

EXAMPLE 1-1

Figure 1:
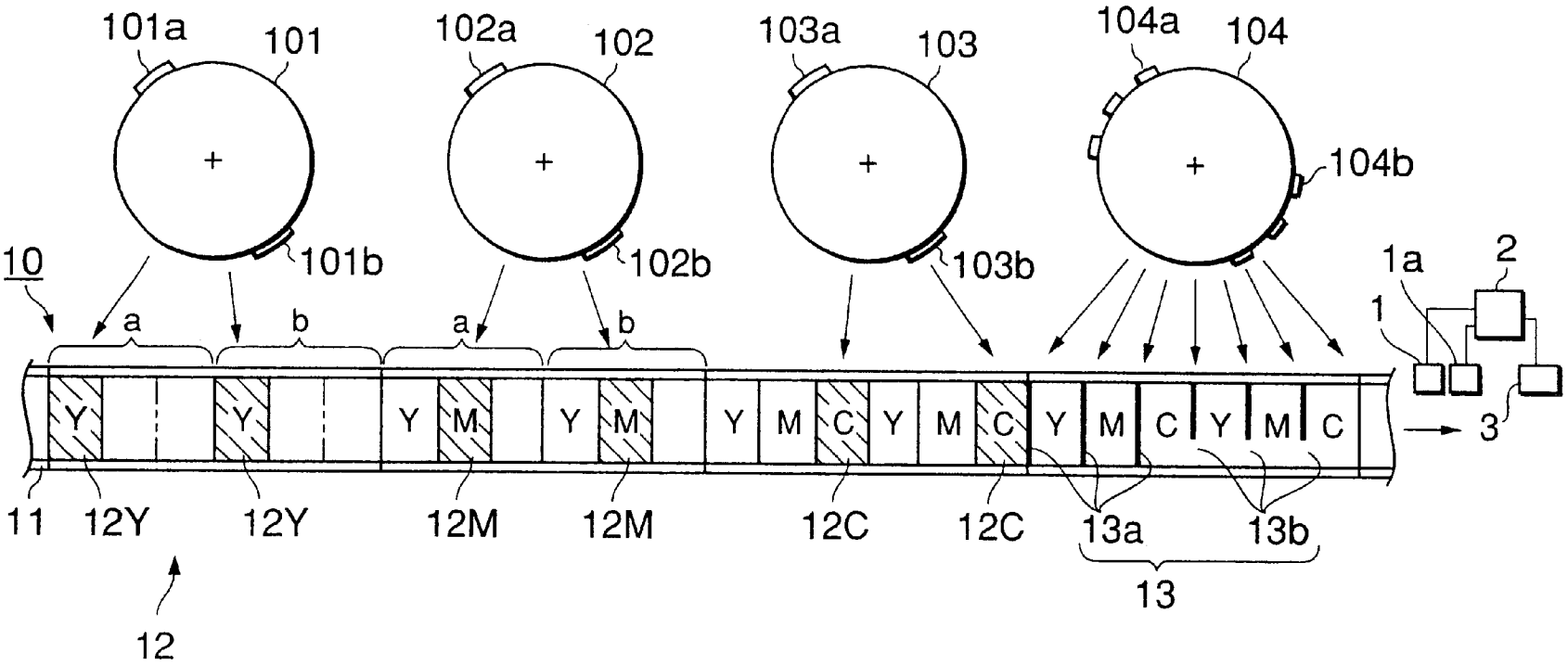
FIG. 1 is a typical view of a transfer sheet in example 1-1 of a first embodiment according to the present invention of assistance in explaining a method of manufacturing the same transfer sheet.
Figure 2:
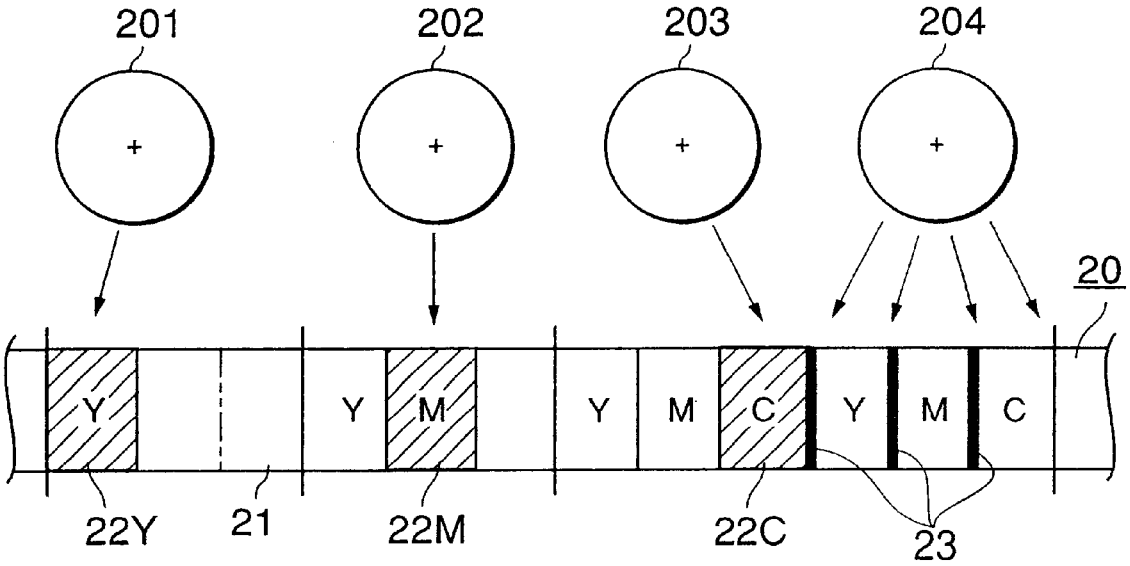
FIG. 2 is a typical view of a conventional transfer sheet of assistance in explaining a method of manufacturing the same transfer sheet.

Referring to FIG. 1 showing a transfer sheet 10 in an example 1-1 of the first embodiment according to the present invention, the transfer sheet 10 comprises a base sheet 11, a thermal transfer layer 12 formed on the base sheet 11, and identification marks 13 (13*a* and 13*b*). The thermal transfer layer 12 has a plurality of YMC transfer region sets a and b, each transfer region set a, b having a plurality of thermal transfer regions 12Y, 12M and 12C respectively. The thermal transfer regions 12Y, 12M and 12C have different functions to each other. The identification marks 13 are formed in each of the YMC transfer region sets a and b.

The base sheet 11 serves as a carrier member of the transfer sheet 10 and may be a sheet having sufficient heat resistance and strength. The base sheet may be a paper sheet, a plastic sheet, such as a PET sheet, or a metal foil of a thickness in the range of 0.5 to 50 $\mu$m, preferably, in the range of 3 to 10 $\mu$m.

The thermal transfer layer 12 is formed on the base sheet 11, and has the plurality of YMC transfer region sets a and b. Each of the sets has an yellow transfer region 12Y, a magenta transfer region 12M and a cyan transfer region 12C longitudinally arranged in that order.

The transfer layer 12 is formed of a resin containing dyes that are melted or sublimated when heated. Preferably, the dyes are hot-sublimable disperse dyes, oil colors or basic dyes, and have a molecular weight in the range of 150 to 800, preferably, in the range of 310 to 700. The dyes are selected from those dyes and colors, taking into consideration the temperature of sublimation, hue, weathering resistance and solubility in an ink base or a binder.

The thermal transfer layer 12 is formed in a thickness in the range of 0.3 to 2 $\mu$m by a suitable printing process, such as a gravure printing process, using composite printing inks each prepared by dissolving a selected dye and a selected resin in a solvent.

The identification marks 13 indicate information about the thermal transfer sheet 10. The identification marks 13 may be formed of any suitable material, provided that the identification marks 13 can be detected by an optical, electrical or magnetic detector.

The information about the thermal transfer sheet 10 indicates the attributes of the thermal transfer sheet 10 including means for discriminating between the front and the back side, means for discriminating between the head and the tail (direction), type, grade, the number of available frames, advanced notification of end, boundaries between the thermal transfer regions, maker, applicable printers and means for indicating genuineness.

The quality of the identification marks 13 is dependent on the detector to be used for detecting the identification marks 13. For example, the identification marks 13 are formed of an optically detectable material prepared by mixing an optically identifiable pigment or dye into a resin, an electrically detectable material, such as a conductive resin prepared by mixing powder of a metal or carbon into a resin, or a metal foil, a magnetically detectable material, such as a magnetic resin prepared by mixing a magnetic metal or a magnetic compound in a resin, or a magnetic metal film formed by evaporation.

Although the detector may be of an optical type, an electrical type or a magnetic type, the use of an optical detector is the simplest in configuration.

When each identification mark 13 is formed in the corresponding transfer region of the thermal transfer layer 12 and the dye or the pigment contained in the material forming the identification mark 13 is of an ordinary hue, a suitable color filter is necessary to detect the identification mark 13. When the transfer region of the thermal transfer layer 12 is formed of a material containing an infrared ray transmitting dye and the identification mark 13 is formed of an infrared ray cutting material, the identification mark 13 can be detected by using an infrared detector regardless of the hue of the corresponding transfer region of the thermal transfer layer 12.

The infrared ray cutting identification mark 13 can be formed of a composite material prepared by mixing an infrared ray cutting substance into a resin. An optimum infrared ray cutting substance is carbon black which absorbs infrared rays very effectively.

The resin as the component of the infrared ray cutting composite material may be a polyurethane resin, a polyamide resin, a vinyl chloride-vinyl acetate copolymer, a vinyl chloride-polyacrylate copolymer, a cellulose acetate butyrate or a mixture of some of those resins. A resin produced by crosslinking some of those resins with a polyisocyanate compound may be used as the component of the infrared ray cutting composite material.

The weight ratio of the infrared ray cutting substance to the resin is in the range of 1/10 to 10/1. The identification marks 13 are formed in a thickness in the range of about 0.5 to about 5 $\mu$m.

The detector for detecting the infrared ray cutting identification marks 13 comprises, for example, an infrared projector 1*a,* such as an infrared emitting diode, disposed on one side of the traveling thermal transfer sheet 10, an infrared photoelectric sensor 1 capable of sensing infrared rays projected by the infrared ray projector 1*a,* a reflector disposed on the other side of the thermal transfer sheet 10, and a controller 2 connected to the infrared photoelectric sensor 1. The controller 1 gives control signals to a printer 3 on the basis of signals given thereto by the infrared photoelectric sensor 1.

When the infrared projector projects infrared rays of a wavelength in the range of 900 to 2500 nm, more preferably, in the range of 900 to 1000 nm, and the infrared sensor is capable of sensing the infrared rays projected by the infrared projector, infrared rays projected by the infrared projector penetrate the thermal transfer layer 12 regardless of the hues of the dyes contained in the thermal transfer layer 12 because those dyes do not absorb infrared rays, and hence the infrared ray cutting identification marks 13 can efficiently be detected.

Accordingly, it is preferable to use substantially infrared ray transmitting dyes for forming the thermal transfer layer 12.

The composition of the components of such a thermal transfer sheet is described in detail in an invention proposed by the applicant of the present patent application in JP-A No. 1-202491, and hence the further description of the composition will be omitted.

The identification marks 13 include at least two different type of identification marks 13*a* and 13*b* respectively having different printed forms for the YMC transfer region sets a and b as shown in a right-hand region of FIG. 1. The identification marks 13*a* and 13*b* are formed so as to correspond to the transfer regions 12Y, 12M and 12C of the YMC transfer region sets a and b, respectively.

A method of manufacturing the transfer sheet 10 will be described.

A Y printing cylinder 101 (Y transfer region printing cylinder), an M printing cylinder (M transfer region printing cylinder) 102 and a C printing cylinder 103 (C transfer region printing cylinder) has a circumference six times the length of the transfer regions 12Y, 12M and 12C. The Y printing cylinder 101 is provided with printing plates 101*a* and 101*b* for printing the Y transfer regions 12Y, the M printing cylinder 102 is provided with printing plates 102*a* and 102*b* for printing the M transfer regions 12M, and the C printing cylinder 103 is provided with printing plates 103*a* and 103*b* for printing the C transfer regions 12C. A mark printing cylinder (identification mark printing cylinder) 104 has a circumference equal to those of the printing cylinders 101, 102 and 103. The mark printing cylinder 104 is provided with a first set of printing plates 104*a* for printing first marks 13*a,* and a second set of printing plates 104*b* for printing second marks 13*b*. The first marks 13*a* are printed in the transfer regions 12Y, 12M and 12C of the first YMC transfer region set a, and the second marks 13*b* are printed in the transfer regions 12Y, 12M and 12C of the second YMC transfer region set b.

The Y printing cylinder 101 prints two Y transfer regions 12Y successively, the M printing cylinder 102 prints two M transfer regions 12M successively, and then the C printing cylinder prints two C transfer regions 12C successively.

Subsequently, the mark printing cylinder 104 prints the first identification marks 13*a* and the second identification marks 13*b* successively.

The identification marks 13*a* and 13*b* indicate, in addition to information about the colors of the corresponding transfer regions 12Y, 12M and 12C, information about the positional relation between the YMC transfer region sets a and b. The characteristics of the transfer regions 12Y, 12M and 12C of the thermal transfer layer 12 of the transfer sheet 10 are measured beforehand by the controller 2 by reading the identification marks 13*a* and 13*b* by the infrared photoelectric sensor 1, and the controller 2 gives correction signals to the printer 3 to correct transfer conditions so that the tones of colors are adjusted properly when the printer operates for printing by using the transfer sheet 10.

The printing cylinders 101, 102 and 103, each provided with the two printing plates enable the efficient manufacture of the transfer sheet 10.

Since the positional relation between the YMC transfer region sets a and b can be known from the identification marks 13*a* and 13*b*, the printer 3 is able to operate so as to correct transfer conditions according to the characteristics of the transfer regions 12Y, 12M and 12C to print a satisfactory image.

In this embodiment, the different identification marks 13*a* and 13*b* are printed in the respective transfer regions 12Y, 12M and 12C of the YMC transfer region sets a and b by the different printing plates 104*a* and 104*b* mounted on the mark printing cylinder 104, respectively. In the following embodiments, the identification marks formed in each YMC transfer region set have the same form and at least one of the identification marks 13*a* and 13*b* formed in the transfer regions 12Y, 12M and 12C of each YMC transfer region set has a characteristic different from those of the other identification marks 13*a* and 13*b* of the same YMC transfer region set, or the identification marks of each YMC transfer region set have the same form and the identification marks 13*a* and 13*b* of at least one YMC transfer region set have a characteristics different from those of the identification marks 13*a* and 13*b* of the other YMC transfer region sets.

A method of forming the identification marks 13*a* and 13*b* in a comparative example will be described and the difference between transfer sheets in comparative examples and the embodiments of the present invention will be elucidated.

Figure 3:
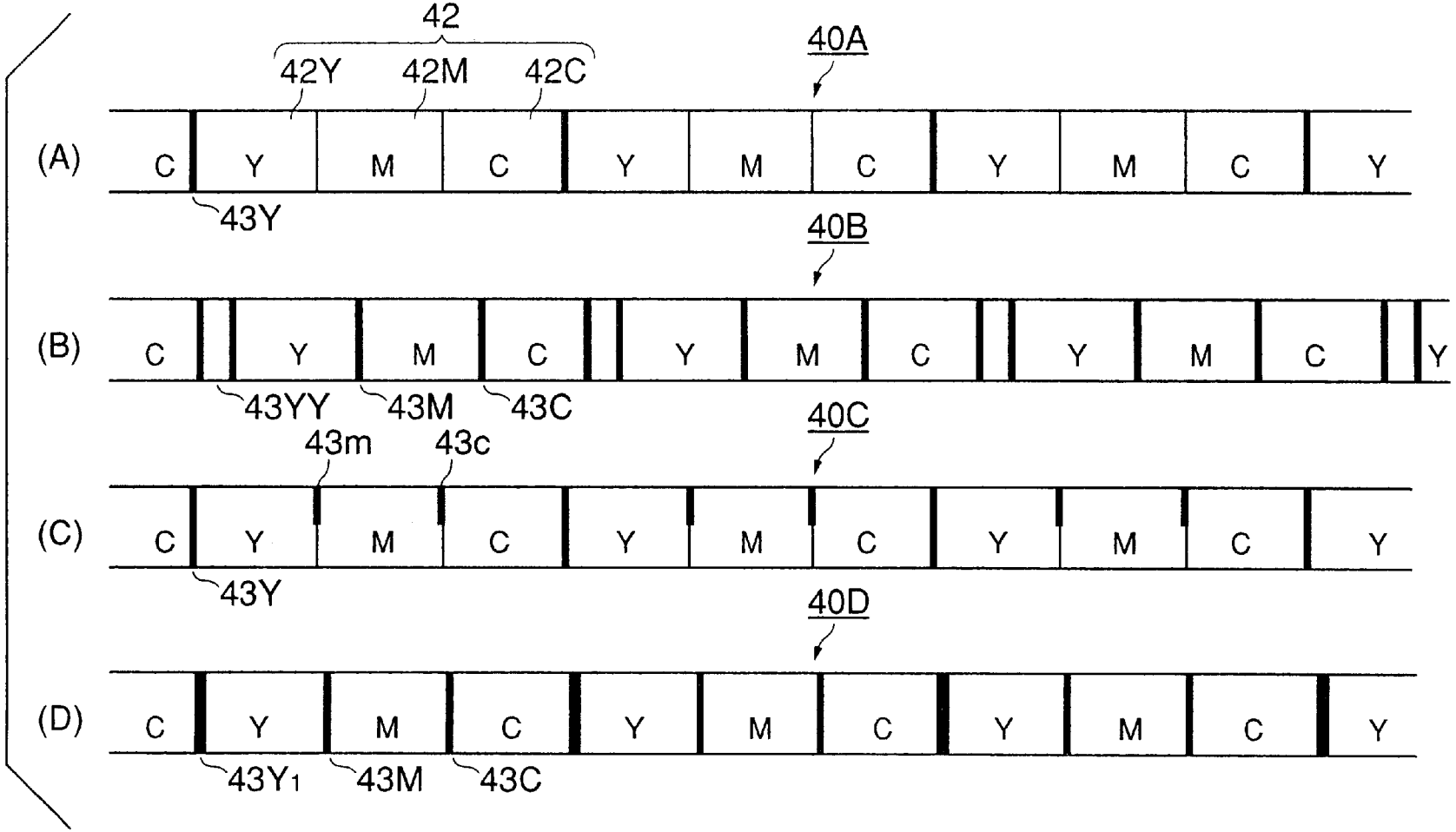
FIGS. 3(A)(B)(C)(D) are plan views of transfer sheets in comparative examples.

FIGS. 3(A)(B)(C) are plan views of transfer sheets in comparative examples. In those comparative examples, the identification marks have the same characteristic.

In a transfer sheet 40A, an identification mark 43Y is formed only in a head transfer region 42Y of each of YMC transfer region sets. Only one photoelectric sensor is necessary to detect the identification marks 43Y. However, the determination of the starting positions of transfer regions 42M and 42C includes large errors because only the identification mark 43Y formed in the head transfer region 42Y is detected and the starting positions of the transfer regions 42M and 42C are estimated on a time basis by counting pulses indicating an angle through which the output shaft of a motor has rotated. Consequently, the starting position of the last transfer region 42C must be formed in a sufficient length longer than that of an actual image area to avoid the extension of the image outside the image area, which increases material costs.

In a transfer sheet 40B, an identification mark 43YY of two lines is formed only in a head transfer region 42Y of each of YMC transfer region sets, and identification marks 43M and 43C each having a single line are formed in other transfer regions 42M and 42C, respectively. Only a single photoelectric sensor is necessary. Each of the identification marks 43YY has two lines, and hence the length of the transfer sheet 40B increases accordingly, which increases the cost of the transfer sheet 40B.

In a transfer sheet 40C, an identification mark 43Y formed in the head transfer region 42Y of each of YMC transfer region sets is a long line of a length equal to the width of the transfer sheet 40C, and identification marks 43*m* and 43*c* formed in the other regions 42M and 42C are a short line of a length shorter than the width of the transfer sheet 40C. Although two photoelectric sensors must be arranged along the width of the transfer sheet 40C to detect the long identification marks 43Y and the short identification marks 43*m* and 43*c*, the length of the transfer sheet 40C need not be increased and time necessary for detection can be reduced.

In a transfer sheet 40D, an identification mark 43$Y_1$ of a thick line is formed in the head transfer region 42Y of each of YMC transfer region sets, and identification marks 43M and 43C of a thin line are formed in the other regions 42M and 42C, respectively. Only a single photoelectric sensor is necessary. The head of each YMC transfer region set can be identified by a long duration of detecting the identification mark 43$Y_1$ of a thick line, and the head of each of the transfer regions 43M and 43C can be identified by a short duration of detecting the identification marks 43M and 43C of a thin line. The length of the transfer sheet 40D increases by a length corresponding to the difference between the thick line forming the identification mark 43$Y_1$ and the thin line forming the identification marks 43M and 43C.

EXAMPLES 1-2 and 1-3

Figure 4:
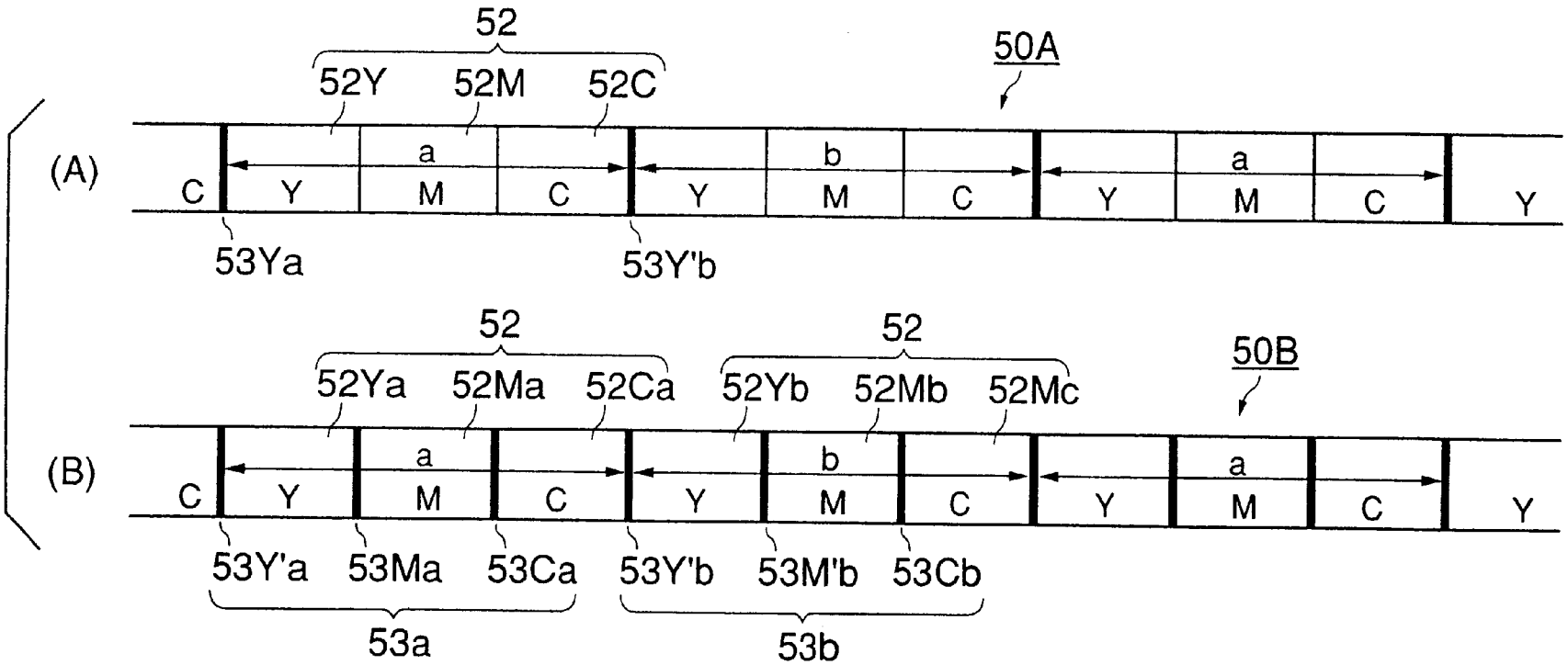
FIGS. 4(A)(B) are plan views of transfer sheets in examples 1-2 and 1-3 of the first embodiment according to the present invention.

FIGS. 4(A) and 4(B) are plan views of transfer sheets in examples 1-2 and 1-3 of the first embodiment according to the present invention, respectively.

Referring to FIG. 4(A), a transfer sheet 50A in the example 1-2 has an alternate arrangement of two YMC transfer region sets a and b, each having three transfer regions 52Y, 52M and 52C respectively of different colors (yellow, magenta and cyan). Identification marks 53Ya and 53Y'b are formed in the head transfer regions 52Y of the YMC transfer region sets a and b, respectively.

The identification marks 53Ya and 53Y'b are the same in form but differ from each other in transmissivity (or reflectivity).

In the following description, an identification mark designated by a reference character without a dash (') has a small transmissivity (high optical density), and an identification mark designated by a reference character with a dash (') has a large transmissivity (low optical density). A photoelectric sensor provides a high-level signal upon the detection of the identification mark designated by a reference character without a dash and provides a low-level signal upon the detection of the identification mark designated by a reference character with a dash.

The transfer sheet 50A can be manufactured by the same method as that of manufacturing the transfer sheet shown in FIG. 1 using printing cylinders each provided with two printing plates.

When the infrared photoelectric sensor 1 is sensitive to infrared rays of a wavelength in the range of 800 to 950 nm, it is preferable in view of avoiding faulty detection that the largest difference in transmissivity (or reflectivity) between the identification marks 53Ya and 53Y'b is 10% or below of the larger one.

The sensitivity of the infrared photoelectric sensor 1 may be adjusted to a level high enough to detect either of the identification marks 53Ya or 53Y'b, having a lower transmissivity.

The positional relation between the two YMC transfer region sets a and b of the transfer sheet 50A can be known because the identification marks 53Ya and 53Y'b have different transmissivities (or reflectivities), respectively. Therefore a satisfactory image can be formed by printing the image after correcting transfer conditions according to the characteristics of the YMC transfer region sets a and b.

As shown in FIG. 4(B), a transfer sheet 50B in an example 1-3 has transfer regions 52Y, 52M and 52C arranged in an arrangement similar to that of the transfer regions 52Y, 52M and 52C of the transfer sheet 50A in the example 1-2. In the transfer sheet 50B, identification marks 53Y'a, 53Ma, 53Ca are formed in the transfer regions 52Ya, 52Ma and 52Ca of a YMC transfer region set a, respectively, and identification marks 53Y'b, 53M'b and 53Cb are formed in the transfer regions 52Yb, 52Mb and 52Cb of a YMC transfer region set b, respectively. The respective identification marks 53a (53Y'a, 53Ma and 53Ca) and 53*b* (53Y'b, 53M'b and 53Cb) of the YMC transfer region sets a and b have the same form.

In the YMC transfer region set a, the identification mark 53Y'a have a transmissivity (reflectivity) different from those of the identification marks 53Ma and 53Ca. In the YMC transfer region set b, the identification mark 53Cb has a transmissivity (reflectivity) different from those of the identification marks 53Y'b and 53M'b.

The identification mark 53Ma of the YMC transfer region set a and the identification mark 53M'b of the YMC transfer region set b differ from each other in transmissivity (reflectivity).

The identification marks 53Y'a and 53Y'b may be of the same form, and the identification marks 53Ca and 53Cb may be of the same form.

An increased number of pieces of information about the thermal transfer sheet 50B can be recorded.

The width and the number of lines of the identification marks differing from each other in property, such as transmissivity, may properly be determined, and information expressed by the identification mark can be identified by the width or the number of pulses generated upon the detection of the identification mark. For example, since the transmissivity cannot visually be determined, the genuineness can easily be known from an identification mark having a complicated form.

For example, when the thermal transfer sheet is loaded into an inappropriate printer other than specified printers or when a nongenuine thermal transfer sheet is loaded into a printer, an error signal is generated to stop using the inappropriate printer or the nongenuine thermal transfer sheet.

A detecting method to be carried out by a printer is described in Japanese Patent No. 2-21951.

EXAMPLES 1-4 to 1-7

FIGS. 5(A) to 5(E) are plan views of transfer sheets in examples 1-4 to 1-7 of the first embodiment according to the present invention.

In each of the transfer sheets shown in FIGS. 5(A) to 5(E), an identification mark formed in the head transfer region of each YMC transfer region set is two lines, and identification marks formed in the other transfer regions of the same YMC transfer region set are a single line.

Figure 5:
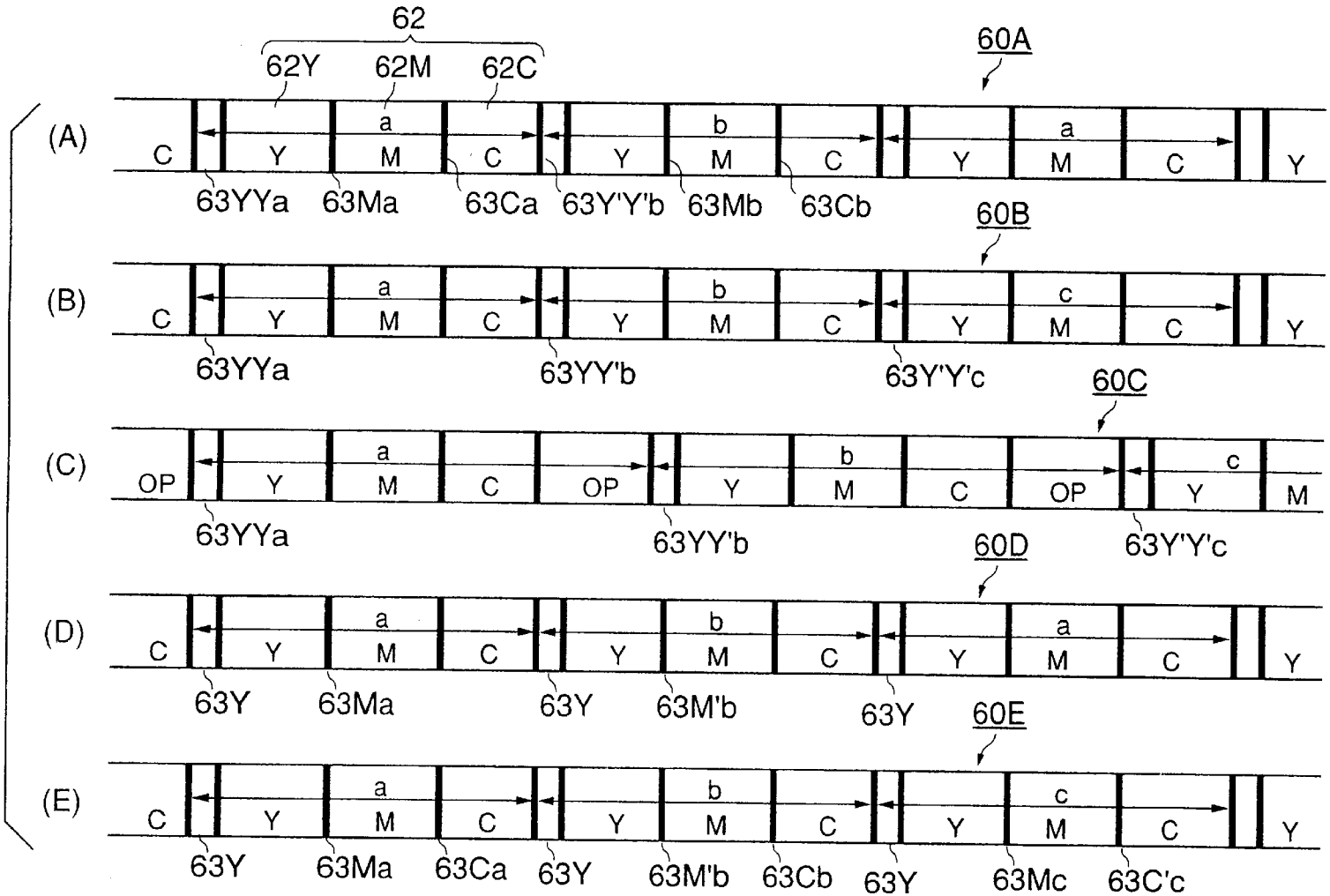
FIGS. 5(A)(B)(C)(D)(E) are plan views of transfer sheets in examples 1-4, 1-5, 1-6 and 1-7 of the first embodiment according to the present invention.

In a transfer sheet 60A in the example 1-4 shown in FIG. 5(A), identification marks 63YYa and 63Y'Y'b formed respectively in the respective head transfer regions of YMC transfer region sets a and b are different from each other in transmissivity.

Each of the Y printing cylinder 101, the M printing cylinder, the C printing cylinder 103 and the mark printing cylinder 104 is provided with three printing plates when forming the transfer regions and the identification marks of a transfer sheet 60B in the example 1-5 shown in FIG. 5(B). An arrangement of three successive YMC transfer region sets a, b and c is formed repeatedly. Identification marks 63YYa, 63YY'b and 63Y'Y'c formed respectively in the respective head transfer regions of YMC transfer region sets a, b and c are different from each other in transmissivity.

A transfer sheet 60C in the example 1-6 shown in FIG. 5(C) is the same in construction as the transfer sheet 60B in the example 1-5, except that each of the YMC transfer region sets a, b and c has a protective region OP in addition to the Y, M and C transfer regions.

A transfer sheet 60D in the example 1-6 shown in FIG. 5(D) is similar to the transfer sheet 60A in the example 1-4. The transfer sheet 60D differs from the transfer sheet 60A in that, in the transfer sheet 60D, the same identification marks 63Y are formed respectively in the respective head transfer regions of YMC transfer region sets a and b, and identification marks 63Ma and 63M'b formed respectively in the magenta transfer regions of the YMC transfer region sets a and b are different from each other in transmissivity.

Each of the Y printing cylinder 101, the M printing cylinder, the C printing cylinder 103 and the mark printing cylinder 104 is provided with three printing plates when forming the transfer regions and the identification marks of a transfer sheet 60E in the example 1-7 shown in FIG. 5(E). An arrangement of three successive YMC transfer region sets a, b and c is formed repeatedly. An identification mark 63Ma formed in the magenta transfer region of the YMC transfer region set a differs in transmissivity from an identification mark 63M'b formed in the magenta transfer region of the YMC transfer region set b, and an identification mark 63Ca formed in the cyan transfer region of the YMC transfer region set a differs in transmissivity from an identification mark 63C'c formed in the cyan transfer region of the YMC transfer region set c.

EXAMPLES 1-8 to 1-10

Figure 6:
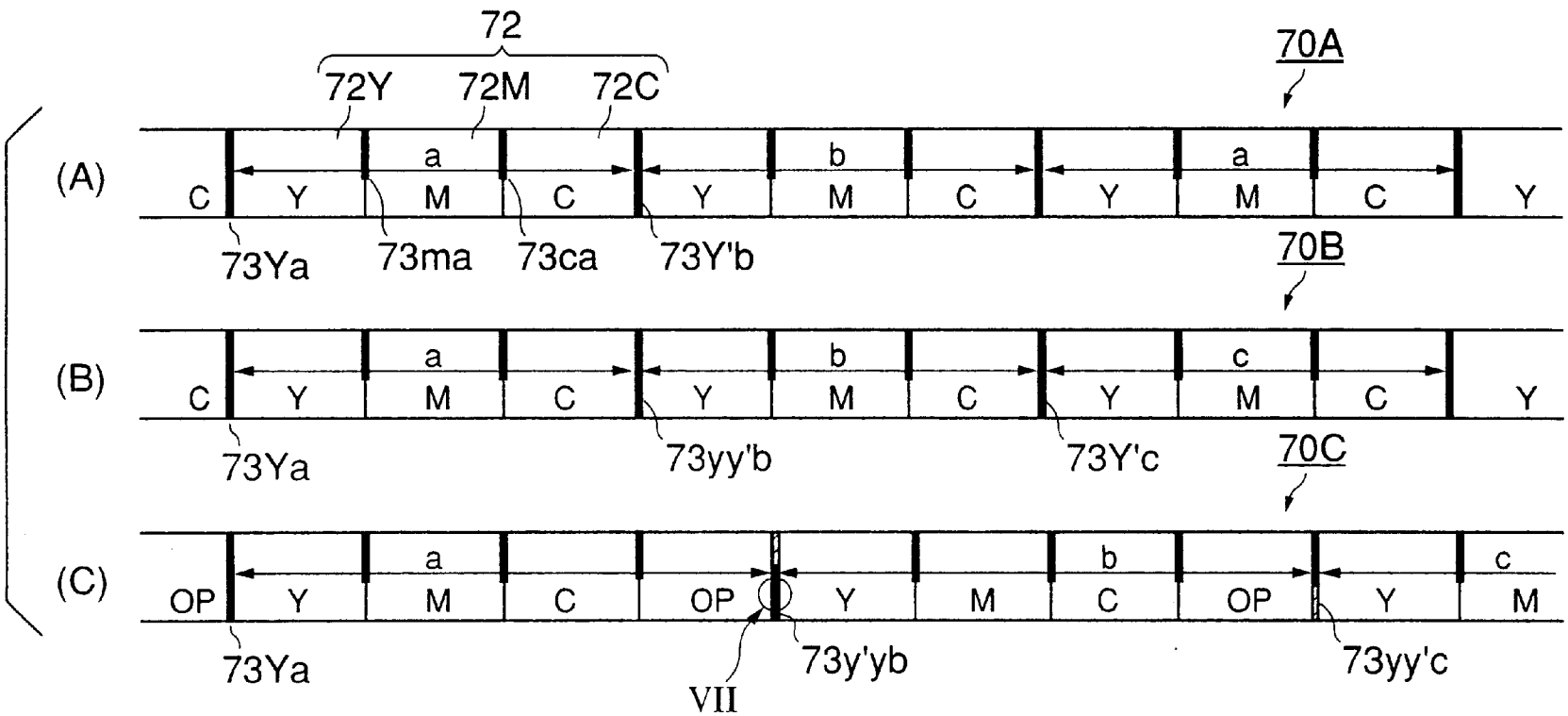
FIGS. 6(A)(B)(C) are plan views of transfer sheets in examples 1-8, 1-9 and 1-10 of the first embodiment according to the present invention.

FIGS. 6(A), 6(B) and 6(C) are plan views of transfer sheets 70A, 70B and 70C in examples 1-8 to 1-10, respectively, of the first embodiment according to the present invention.

In each of the transfer sheets 70A, 70B and 70C, an identification mark formed in the head transfer region of each YMC transfer region set is a single long line of a length equal to the width of the transfer sheet, and identification marks formed in the other transfer regions are a single short line of a length equal to about half the width of the transfer sheet. Two photoelectric sensors must be arranged along the width of each of the transfer sheets 70A, 70B and 70C to detect the long identification marks and the short identification marks of each of the transfer sheets 70A, 70B and 70C.

In the transfer sheet 70A in the example 1-8 shown in FIG. 6(A), identification marks 73Ya and 73Y'b formed in the respective head transfer regions of YMC transfer regions a and b differ from each other in transmissivity.

Each of the Y printing cylinder 101, the M printing cylinder, the C printing cylinder 103 and the mark printing cylinder 104 is provided with three printing plates when forming the transfer regions and the identification marks of the transfer sheet 70B in the example 1-9 shown in FIG. 6(B). An arrangement of three successive YMC transfer region sets a, b and c is formed repeatedly. Identification marks 73Ya, 73*yy'b'* and 73Y'c formed respectively in the respective head transfer regions of the YMC transfer region sets a, b and c differ from each other in transmissivity. The identification mark 73*yy'b* is a single line having one half part having a small transmissivity and the other half part having a large transmissivity.

The transfer regions and the identification marks of the transfer sheet 70C in the example 1-10 shown in FIG. 6(C), similarly to those of the transfer sheet 70B, are formed by using the Y printing cylinder 101, the M printing cylinder, the C printing cylinder 103 and the mark printing cylinder 104 each provided with three printing plates. The transfer sheet 70C, similarly to the transfer sheet 60C in the example 1-6, is provided with protective regions OP. An identification mark 73Ya formed in the head transfer region of a YMC transfer region set a have a transmissivity different from those of identification marks 73*y'yb* and 73*yy'c* formed respectively in the head transfer regions of YMC transfer region sets b and c. Each of the identification marks 73*y'yb* and 73*yy'c* is a single line having one half part having a small transmissivity and the other half part having a large transmissivity. As viewed in FIG. 6(C), the upper half part of the identification mark 73*y'yb* has a large transmissivity and the lower half part of the same has a small transmissivity, while the upper half part of the identification mark 73*yy'c* has a small transmissivity and the lower half part of the same has a large transmissivity.

According to this example, one photoelectric sensor 1 can securely detect the identification marks in the head transfer region and the other transfer regions of each YMC transfer region set, and the transfer sheets can have a reasonable length, not an unnecessarily longer one, and the time for detecting the identification marks can be reduced.

Figure 7:
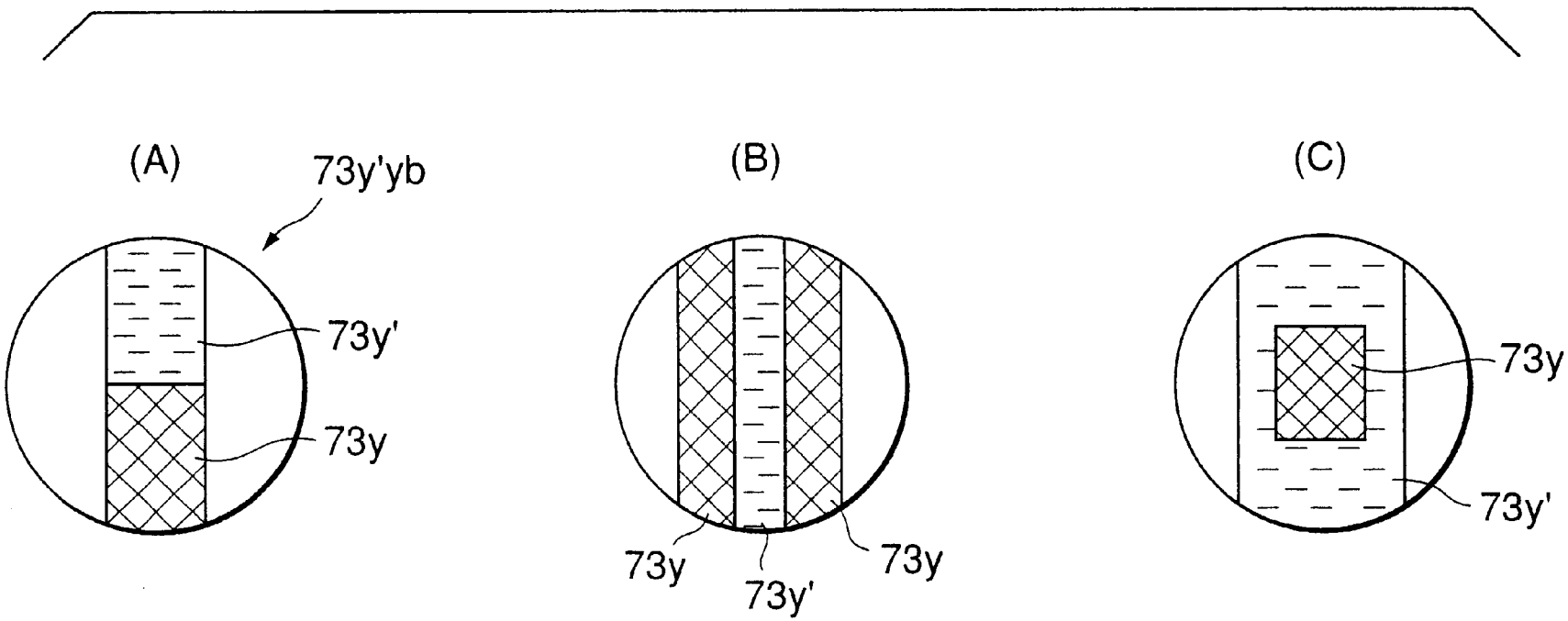

FIGS. 7(A) to 7(C) are enlarged views of the identification marks formed in the transfer sheet 70C in the example 1-10 and modifications of the same.

As shown in FIG. 7(A), the identification mark 73*y'yb* has one half part 73*y'* having a small transmissivity, and the other half part 73*y* having a large transmissivity. An identification mark in a modification shown in FIG. 7(B) has three parallel parts 73*y*, 73*y'* and 73*y* arranged longitudinally in that order and having different transmissivities, respectively. This identification mark is capable of carrying an increased number of pieces of information. An identification mark in a further modification may consists of two, four or more than four parallel parts having different transmissivities, respectively.

An identification mark in a modification shown in FIG. 7(C) has one part 73*y'* and the other part 73*y* surrounded by the part 73*y'*. In a further modification, two or more than two parts 73*y* may be formed in a part 73*y'*.

The first embodiment according to the present invention is not limited in its practical application to the examples 1-1 to 1-10, and various changes and variations are possible therein without departing from the scope of the present invention.

For example, printing cylinders each provided with four or more than four printing plates may be used for printing the transfer regions and the identification marks.

The transfer sheets may be provided, in addition to the protective regions OP, with receiving regions.

As is apparent from the foregoing description, according to the present invention, the transfer sheet can efficiently be manufactured by using printing cylinders each provided with a plurality of printing plates.

Since the YMC transfer region sets formed by using printing cylinders each provided with a plurality of printing plates can be identified by the identification marks, images of a satisfactory picture quality can be formed by printing the image after correcting transfer conditions according to the characteristics of the YMC transfer region sets.

Second Embodiment

EXAMPLE 2-1

Figure 8:
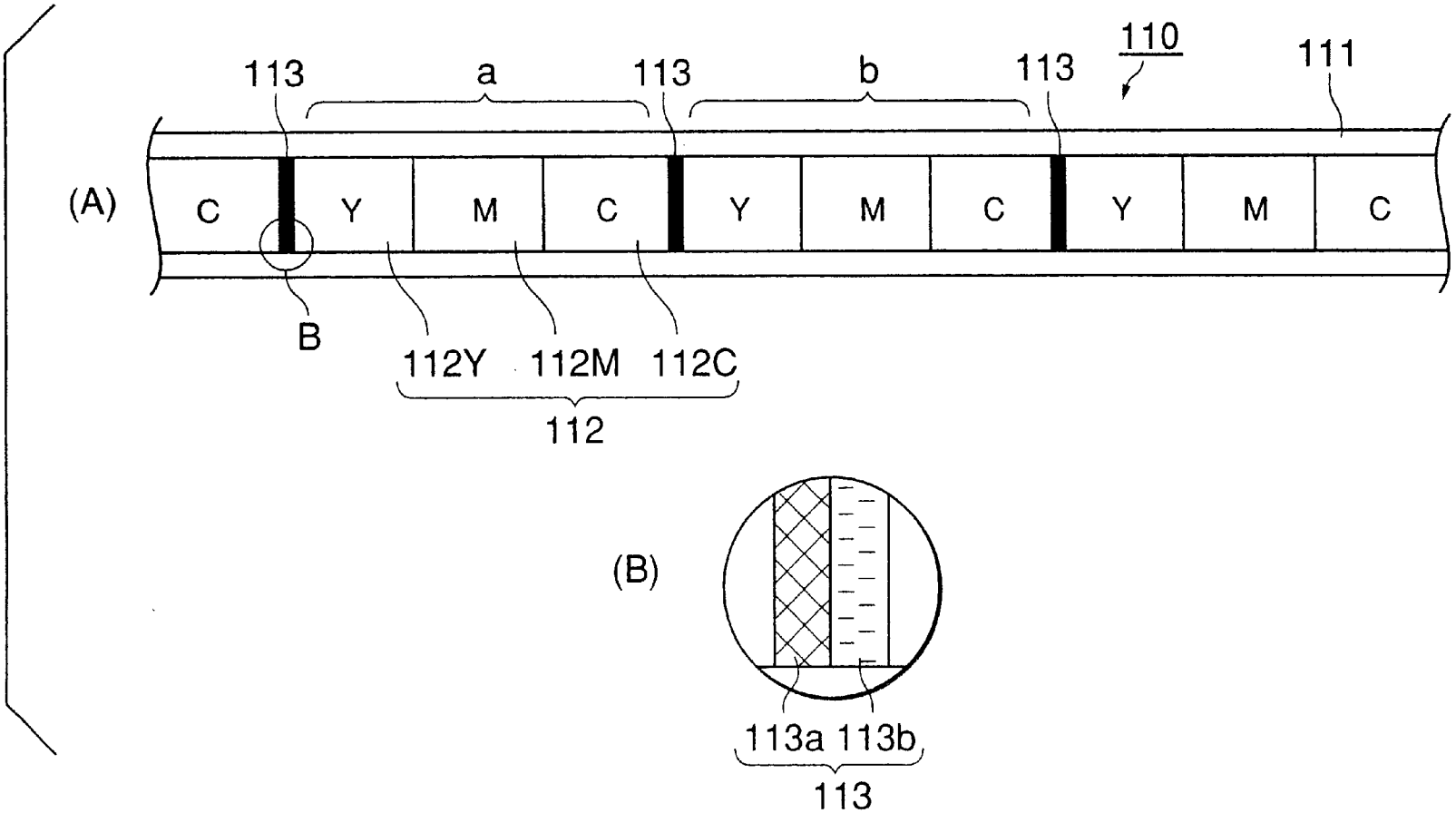
FIGS. 8(A) and 8(B) are typical views of a transfer sheet in an example 2-1 of a second embodiment according to the present invention.

FIGS. 8(A) and 8(B) are typical plan views of a transfer sheet 110 in an example 2-1 of a second embodiment according to the present invention and an enlarged view of a part of the transfer sheet, respectively.

The transfer sheet 110 comprises a base sheet 111, a thermal transfer layer 112 formed on the base sheet 111, and identification marks 113. The thermal transfer layer 112 has a plurality of YMC transfer region sets a and b, each transfer region set having transfer regions 112Y, 112M and 112C respectively having different functions.

The base sheet 111 serves as a carrier member of the transfer sheet 110 and may be a sheet having sufficient heat resistance and strength. The base sheet may be a paper sheet, a plastic sheet, such as a PET sheet, or a metal foil of a thickness in the range of 0.5 to 50 $\mu$m, preferably, in the range of 3 to 10 $\mu$m.

The thermal transfer layer 112 is formed on the base sheet 111, and has the plurality of YMC transfer region sets a and b each of an yellow transfer region 112Y, a magenta transfer region 112M and a cyan transfer region 112C longitudinally arranged in that order.

The transfer layer 112 is formed of a resin containing dyes that are melted or sublimated when heated. Preferably, the dyes are hot-sublimable disperse dyes, oil colors or basic dyes, and have a molecular weight in the range of 150 to 800, preferably, in the range of 310 to 700. The dyes are selected from those dyes and colors, taking into consideration the temperature of sublimation, hue, weathering resistance and solubility in an ink base or a binder.

The thermal transfer layer 112 is formed in a thickness in the range of 0.3 to 2 $\mu$m by a suitable printing process, such as a gravure printing process, using composite printing inks each prepared by dissolving a selected dye and a selected resin in a solvent.

The identification marks 113 indicate information about the thermal transfer sheet 110. The identification marks 113 may be formed of any suitable material, provided that the identification marks 113 can be detected by an optical, electrical or magnetic detector.

The information about the thermal transfer sheet 110 indicates the attributes of the thermal transfer sheet 110 including means for discriminating between the front and the back side, a recording starting position, means for discriminating between the head and the tail (direction), type, grade, the number of available frames, advanced notification of end, boundaries between the thermal transfer regions, maker, applicable printers and means for indicating genuineness.

The quality of the identification marks 113 is dependent on the detector to be used for detecting the identification marks 113. For example, the identification marks 113 are formed of an optically detectable material prepared by mixing an optically identifiable pigment or dye into a resin, an electrically detectable material, such as a conductive resin prepared by mixing powder of a metal or carbon into a resin, or a metal foil, a magnetically detectable material, such as a magnetic resin prepared by mixing a magnetic metal or a magnetic compound in a resin, or a magnetic metal film formed by evaporation.

Although the detector may be of an optical type, an electrical type or a magnetic type, the use of an optical detector is the simplest in configuration.

When each identification mark 113 is formed in the corresponding transfer region of the thermal transfer layer 112 and the dye or the pigment contained in the material forming the identification mark 113 is of an ordinary hue, a suitable color filter is necessary to detect the identification mark 113. When the transfer region of the thermal transfer layer 112 is formed of a material containing an infrared ray transmitting dye and the identification mark 113 is formed of an infrared ray cutting material, the identification mark 113 can be detected by using an infrared detector regardless of the hue of the corresponding transfer region of the thermal transfer layer 112.

The infrared ray cutting identification mark 113 can be formed of a composite material prepared by mixing an infrared ray cutting substance into a resin. An optimum infrared ray cutting substance is carbon black which absorbs infrared rays very effectively.

The resin as the component of the infrared ray cutting composite material may be a polyurethane resin, a polyamide resin, a vinyl chloride-vinyl acetate copolymer, a vinyl chloride-polyacrylate copolymer, a cellulose acetate butyrate or a mixture of some of those resins. A resin produced by crosslinking some of those resins with a polyisocyanate compound may be used as the component of the infrared ray cutting composite material.

The weight ratio of the infrared ray cutting substance to the resin is in the range of 1/10 to 10/1. The identification marks 113 are formed in a thickness in the range of about 0.5 to about 5 $\mu$m.

The detector for detecting the infrared ray cutting identification marks 113 comprises, for example, an infrared projector 1*a,* such as an infrared emitting diode, disposed on one side of the traveling thermal transfer sheet 110, an infrared photoelectric sensor 1 capable of sensing infrared rays projected by the infrared ray projector 1*a,* a reflector disposed on the other side of the thermal transfer sheet 110, and a controller 2 connected to the infrared photoelectric sensor 1. The controller 1 gives control signals to a printer 3 on the basis of signals given thereto by the infrared photoelectric sensor 1.

When the infrared projector projects infrared rays of a wavelength in the range of 900 to 2500 nm, more preferably, in the range of 900 to 1000 nm, and the infrared sensor is capable of sensing the infrared rays projected by the infrared projector, infrared rays projected by the infrared projector penetrate the thermal transfer layer 112 regardless of the hues of the dyes contained in the thermal transfer layer 112 because those dyes do not absorb infrared rays, and hence the infrared ray cutting identification marks 113 can efficiently be detected.

Accordingly, it is preferable to use substantially infrared ray transmitting dyes for forming the thermal transfer layer 112.

As shown in FIG. 8(B), each of the identification marks 113 consists of parts 113*a* and 113*b* differing from each other in transmissivity (or reflectivity). Each of the YMC transfer region sets a and b may be provided with only one identification mark 113 as shown in FIG. 8(A).

When the infrared photoelectric sensor 1 is sensitive to infrared rays of a wavelength in the range of 400 to 700 nm (range of visibility), it is preferable in view of avoiding faulty detection that the largest difference in transmissivity (reflectivity) between the identification marks 113*a* and 113*b* is 10% or below of the larger one.

In addition, when the infrared photoelectric sensor 1 is sensitive to infrared rays of a wavelength in the range of 800 to 950 nm, it is also preferable that the largest transmissivity or reflectivity is 1 to 10% and the smallest transmissivity or reflectivity is below 1%.

In general, the identification marks consist of black marks including carbon black. When a general-purpose 1R sensor detects the identification marks whose transmissivity is more than 10%, the detection of the identification marks can not be stable. It is also preferable in view of avoiding faulty detection that the transmissivity of the identification marks has 10% or below for any wavelength.

The parts 113*a* and 113*b* of the identification mark 113 differing from each other in transmissivity (or reflectivity) can be formed by a gravure printing process using a gravure printing plate having depressed areas of different thicknesses for the parts 113*a* and 113*b,* respectively. The identification mark 113 may consists of any suitable number of parts of any suitable width. Information represented by the identification mark 113 can be known from the width or the number of pulses generated upon the detection of the identification mark 113.

The sensitivity of the photoelectric sensor is adjusted so as to be able to detect either the parts 113*a* or the part 113*b* having a smaller transmissivity. For example, since the transmissivity cannot visually be determined, the genuineness can easily be known from an identification mark having a complicated form.

The identification mark 113 having the parts 113*a* and 113*b* differing from each other in transmissivity (or reflectivity) is able to express an increased number of pieces of information.

For example, when the thermal transfer sheet is loaded into an inappropriate printer other than specified printers or when a nongenuine thermal transfer sheet is loaded into a printer, an error signal is generated to stop using the inappropriate printer or the nongenuine thermal transfer sheet.

EXAMPLES 2-2 to 2-5

FIGS. 9(A) to 9(D) are plan views of transfer sheets 110A, 110B, 110C and 110D in examples 2-2 to 2-5 of the second embodiment according to the present invention.

Each of identification marks 113 formed in the transfer sheets 110A, 110B, 110C and 110D, similarly to those formed in the transfer sheet 110 in the example 2-1, consists of two parts 113*a* and 113*b* differing from each other in transmissivity (or reflectivity).

Figure 9:
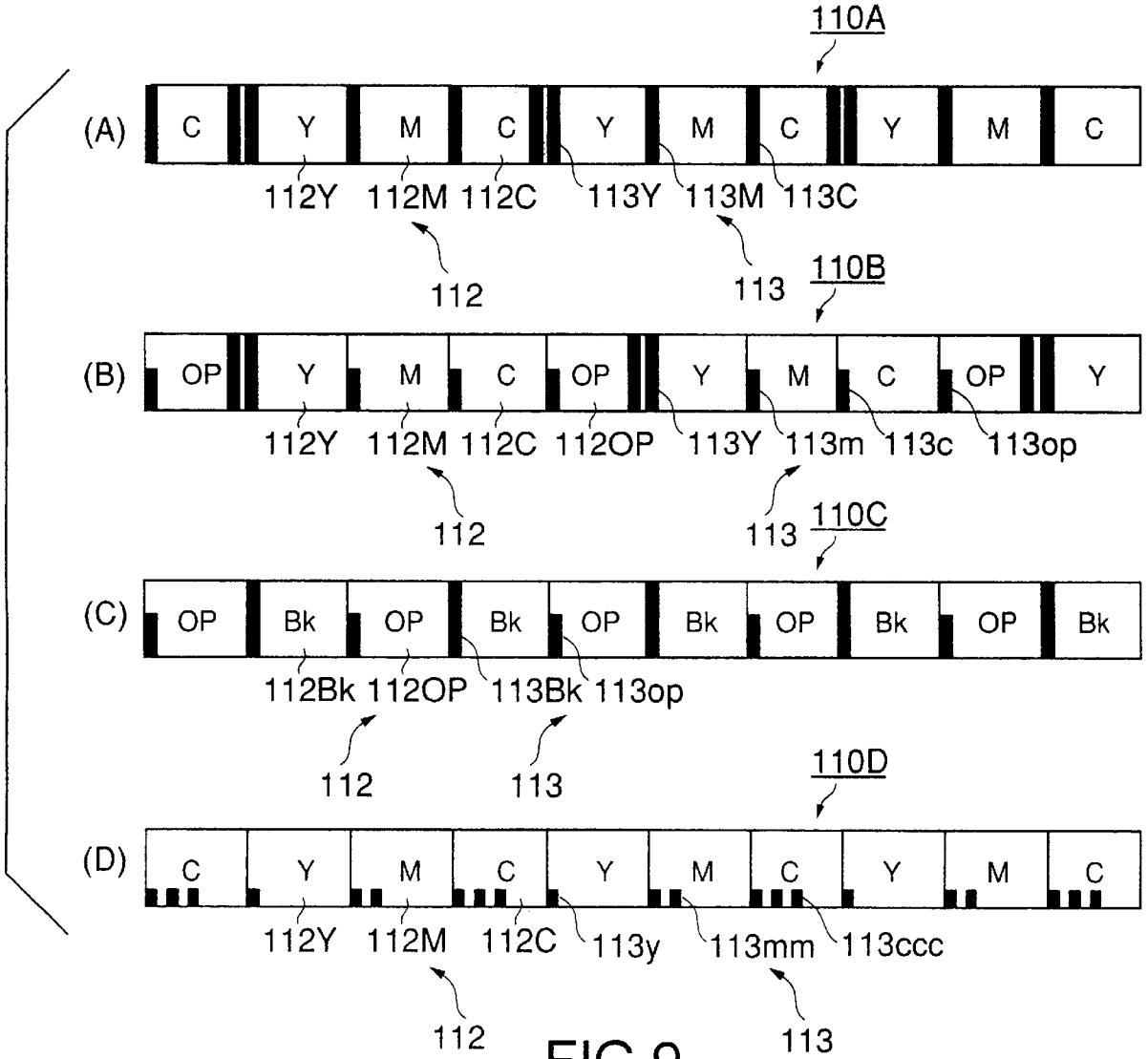
FIGS. 9(A), 9(B), 9(C) and 9(D) are plan views of transfer sheets in examples 2-2, 2-3, 2-4 and 2-5 of the second embodiment according to the present invention.

In the transfer sheet 110A in the example 2-2 shown in FIG. 9(A), identification marks 113Y, 113M and 113C are formed in Y transfer regions 112Y, M transfer regions 112M and C transfer regions 112C, respectively. Each of the identification marks 113Y, 113M and 113C is a single line of a length equal to the width of the transfer sheet 110A. Each of the identification marks 113Y, 113M and 113C indicates information about the starting edge and the color of the corresponding transfer region. Therefore, it is possible to avoid the faulty detection of the transfer regions 112Y, 112M and 112C due to an accidental skip of the identification marks in detecting the identification marks 113Y, 113M and 113C.

The transfer sheet 110B in the example 2-3 has a protective layer having protective regions 1120P in addition to a thermal transfer layer 112 having Y transfer regions 112Y, M transfer regions 112M and C transfer regions 112C as shown in FIG. 9(B). Identification marks 113YY, 113*m,* 113*c* and 113*op* are formed in the Y transfer regions 112Y, the M transfer regions 112M, the C transfer regions 112C and the protective regions 112OP, respectively. The identification mark 113YY consists of two lines of a length equal to the width of the transfer sheet 110B, and each of the identification marks 113*m,* 113*c* and 113*op* is a line of a length shorter than the width of the transfer sheet 110B.

The transfer sheet 110C in the example 2-4 has a thermal transfer layer 112 having black transfer regions 112Bk and protective regions 112OP as shown in FIG. 9(C). Identification marks 113Bk and 113*op* are formed in the black transfer regions 112Bk and protective regions 112OP, respectively. Each of the identification marks 113Bk is a line of a length equal to the width of the transfer sheet 110C, and each of the identification marks 113*op* is a line of a length shorter than the width of the transfer sheet 110C.

The transfer sheet 110D in the example 2-5 has a thermal transfer layer 112 having transfer regions 112Y, 112M and 112C as shown in FIG. 9(D). Identification marks 113*y*, 113*mm* and 113*ccc* are formed in the transfer regions 112Y, 112M and 112C, respectively. The identification marks 113*y*, 113*mm* and 113*ccc* are a single rectangle, two rectangles and three rectangles formed on one side edge of the corresponding transfer regions 112Y, 112M and 112C, respectively.

EXAMPLES 2-6 to 2-8

Figure 10:
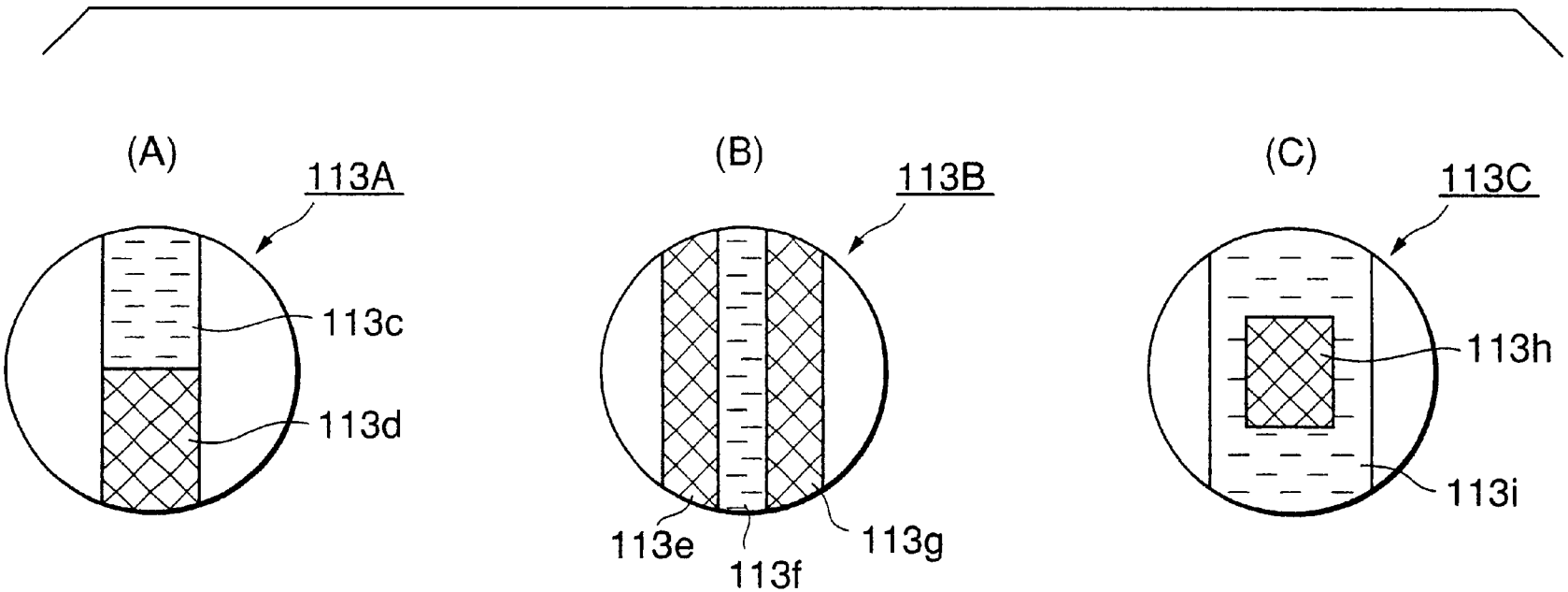
FIGS. 10(A), 10(B) and 10(C) are enlarged views of identification marks formed in transfer sheets in examples 2-6, 2-7 and 2-8 of the second embodiment according to the present invention.

FIGS. 10(A) to 10(C) are enlarged fragmentary plan views of identification marks 113A, 113B and 113C employed in transfer sheets in examples 2-6 to 2-8.

As shown in FIG. 10(A), the identification mark 113A employed in the example 2-6 has one half part 113*c* having a small transmissivity, and the other half part 113*d* having a large transmissivity.

As shown in FIG. 10(B), the identification mark 113B employed in the example 2-7 has three parallel parts 113*e*, 113*f* and 113*g* arranged longitudinally in that order and having different transmissivities, respectively. This identification mark is capable of carrying an increased number of pieces of information. In a modification, an identification mark may consists of four or more than four parallel parts having different transmissivities, respectively.

The identification mark 113C shown in FIG. 10(C) has one part 113*h* and the other part 113*i* surrounding the part 113*h*. In a modification, two or more than two parts 113*h* may be formed in a part 113*i*.

Each of the identification marks employed in those examples consists of the two parts differing from each other in characteristic. In the following examples, identification marks of different characteristics are formed in different transfer regions, respectively.

EXAMPLES 2-9 to 2-11

Figure 11:
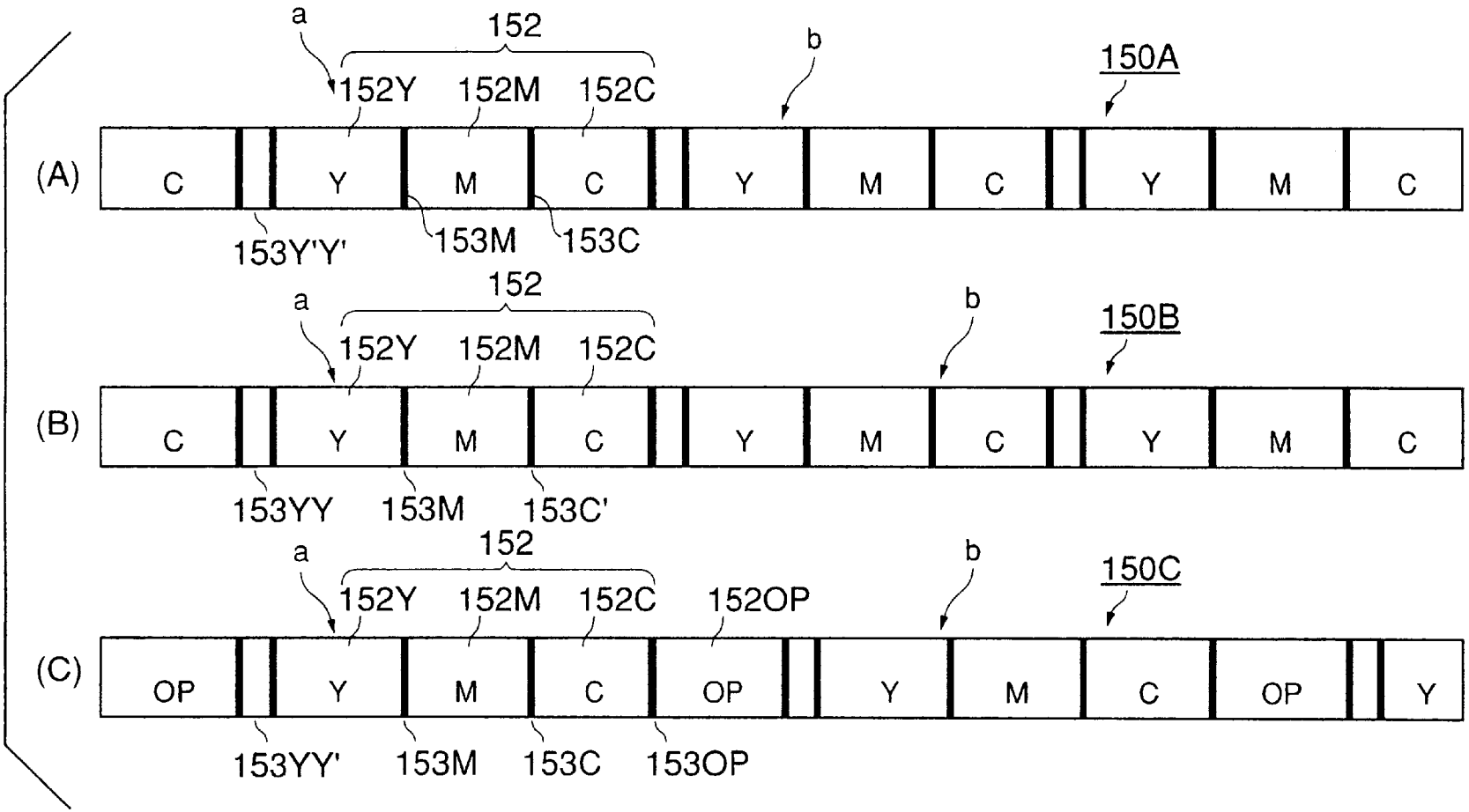
FIGS. 11(A), 11(B) and 11(C) are plan views of transfer sheets in examples 2-9, 2-10 and 2-11 of the second embodiment according to the present invention.

FIGS. 11(A) to 11(C) are plan views of transfer sheets 150A, 150B and 150C in examples 2-9 to 2-11, respectively.

The transfer sheets 150A, 150B and 150C are the same in morphology as the transfer sheet 40B shown in FIG. 3(B) and differ from each other in type.

In the transfer sheet 150A in the example 2-9, an identification mark 153Y'Y' consisting of two lines having a large transmissivity (or reflectivity) is formed in the head transfer region 152Y of each of YMC transfer region sets a and b, and identification marks 153M and 153C each of a single line having a small transmissivity (or reflectivity) are formed in the other transfer regions 152M and 152C of the same YMC transfer region set, respectively.

The identification mark 153Y'Y' differs from the identification marks 153M and 153C in transmissivity (or reflectivity) to a light beam used by the infrared photoelectric sensor 1.

When the infrared photoelectric sensor 1 is sensitive to infrared rays of a wavelength in the range of 800 to 950 nm, it is preferable in view of avoiding faulty detection that the largest difference in transmissivity (reflectivity) between the identification marks 153Y'Y', and the identification marks 153M and 153C is 10% or below of the larger one. The relation in transmissivity (or reflectivity) between the identification marks 153Y'Y', 153M and 153C is the same as that between the identification marks in the example 2-1, and hence the further description thereof will be omitted. In the following description, it is assumed that the identification marks differ from each other in transmissivity.

In the transfer sheet 150B in the example 2-10, an identification mark 153YY consisting of two lines having a small transmissivity is formed in the head transfer region 152Y of each of YMC transfer region sets a and b, an identification mark 153M of a single line having a small transmissivity is formed in transfer regions 152M, and an identification mark 153C' of a single line having a large transmissivity is formed in transfer regions 152C as shown in FIG 11(B).

In the transfer sheet 150C in the example 2-11, an identification mark 153YY' consisting of two lines, one line having a small transmissivity and the other line having a large transmissivity, is formed in the head transfer region 152Y of each of YMC transfer region sets a and b, and identification marks 153M, 153C and 153OP, each having a single line having a small transmissivity are formed in transfer regions 152M, 152C and 152OP, respectively, as shown in FIG. 11(C).

EXAMPLES 2-12 to 2-14

Figure 12:
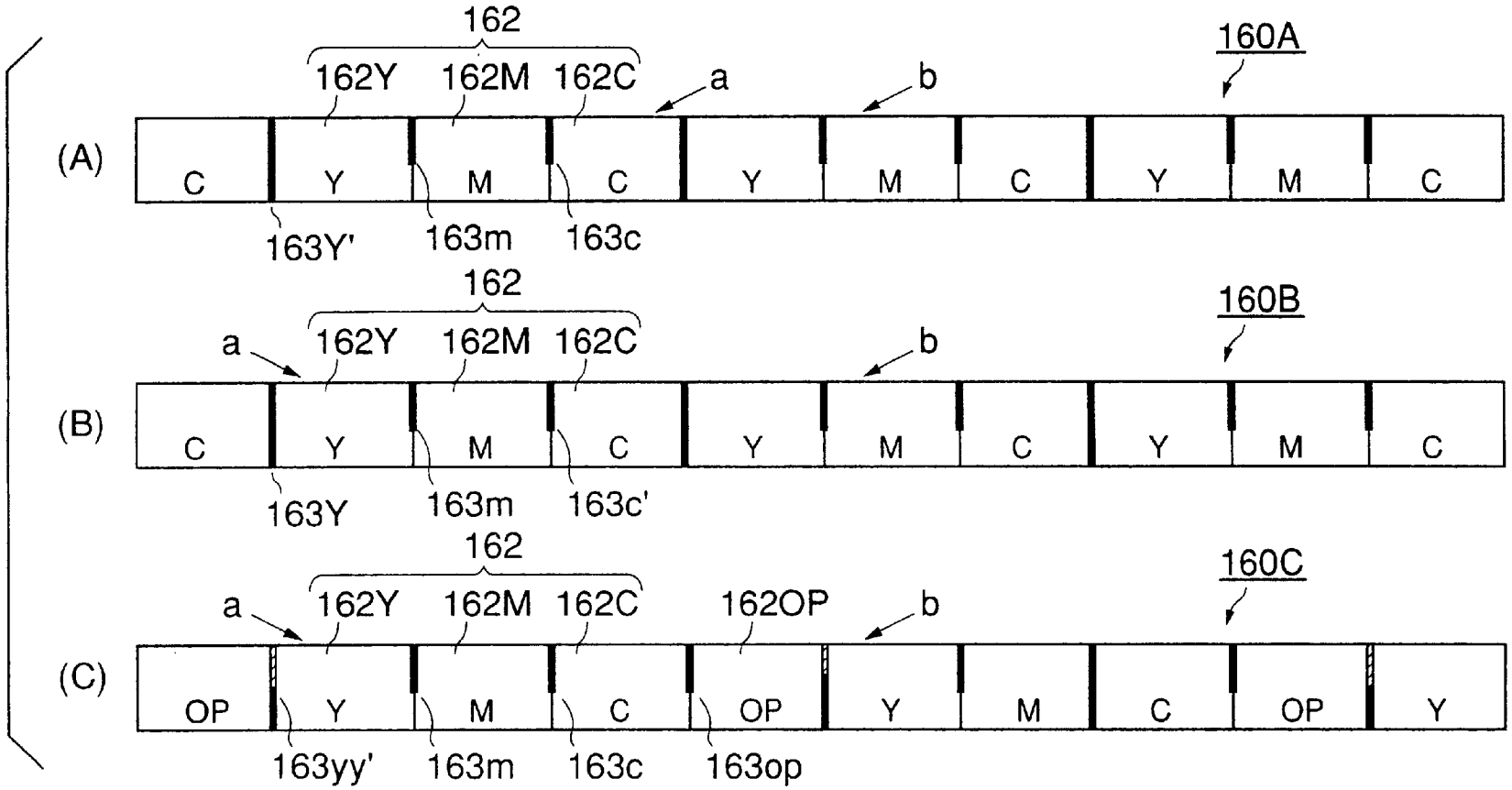
FIGS. 12(A), 12(B) and 12(C) are plan views of transfer sheets in examples 2-12, 2-13 and 2-14 of the second embodiment according to the present invention.

FIGS. 12(A) to 12(C) are plan views of transfer sheets 160A, 160B and 160C in examples 2-12 to 2-14, respectively.

The transfer sheets 160A, 160B and 160C are the same in morphology as the transfer sheet 40C shown in FIG. 3(C) and differ from each other in type.

In the transfer sheet 160A in the example 2-12, an identification mark 163Y' of a single line having a length equal to the width of the transfer sheet 160A and a large transmissivity, is formed in the head transfer region 162Y of each of YMC transfer region sets a and b, and identification marks 163*m* and 163*c*, each having a single line having a length shorter than the width of the transfer sheet 160A and a large transmissivity are formed in the other transfer regions 162M and 162C of the same YMC transfer region set, respectively.

In the transfer sheet 160B in the example 2-13, an identification mark 163Y of a single line having a length equal to the width of the transfer sheet 160B and a small transmissivity is formed in the head transfer region 162Y of each of YMC transfer region sets a and b, an identification mark 163*m* of a single line having a length shorter than the width of the transfer sheet 160B and a large transmissivity is formed in transfer regions 162M, and an identification mark 163*c*' of a single line having a length shorter than the width of the transfer sheet 160B and a small transmissivity is formed in transfer regions 162C as shown in FIG. 12(B).

In the transfer sheet 160C in the example 2-14, an identification mark 163*yy*' of a single line having a length equal to the width of the transfer sheet 160C is formed in the head transfer region 162Y of each of YMC transfer region sets a and b, and identification marks 163*m*, 163*c* and 163*op*, each having a single line having a length shorter than the width of the transfer sheet 160C and a large transmissivity are formed in transfer regions 162M and 162C and protective regions 162OP, respectively, as shown in FIG. 12(C). The identification mark 163*yy*' has one part having a small transmissivity and the other part having a large transmissivity.

The transfer regions of the transfer sheets 160A, 160B and 160C in these examples can be identified by using a single photoelectric sensor 1. An increased number of pieces of information are available if two photoelectric sensors 1 are used. The identification marks do not increase the lengths of the transfer sheets 160A, 160B and 160C and can be detected in a short time.

EXAMPLES 2-15 and 2-16

Figure 13:
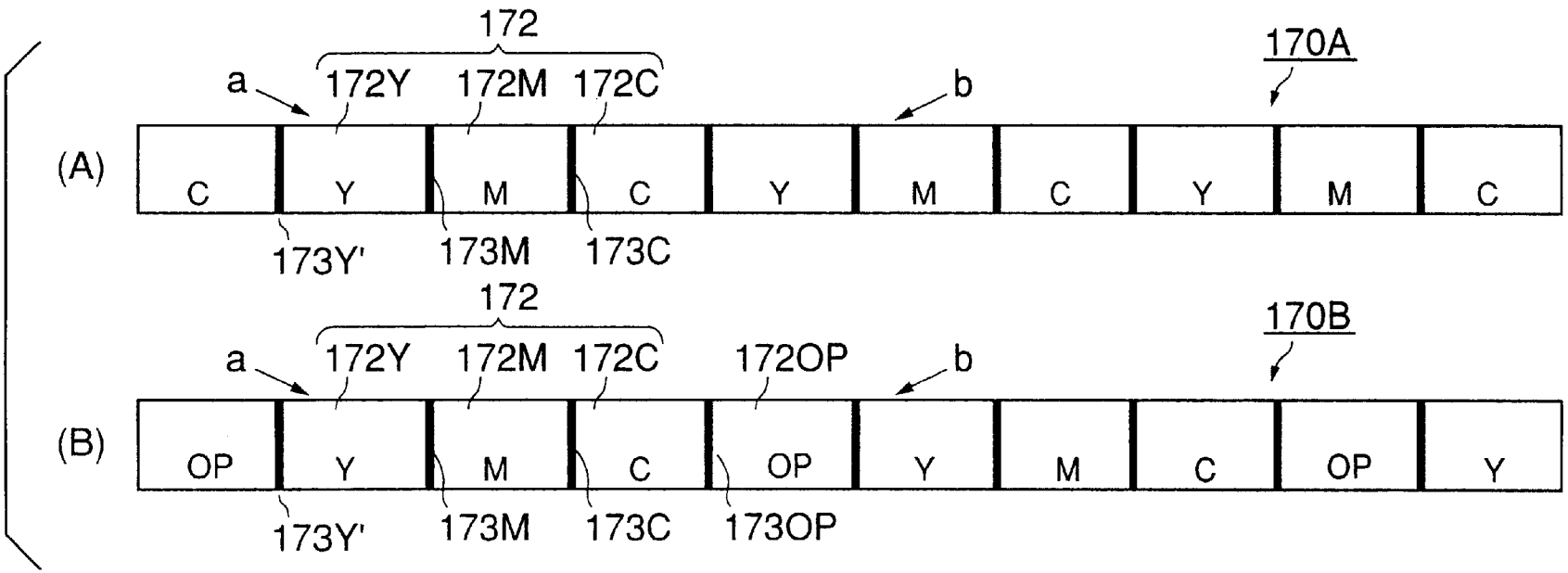
FIGS. 13(A) and 13(B) are plan views of transfer sheets in examples 2-15 and 2-16 in the second embodiment according to the present invention.

FIGS. 13(A) and 13(B) are plan views of a transfer sheet 170A in an example 2-15 and a transfer sheet 170B in an example 2-16.

In the transfer sheet 170A in the example 2-15, an identification mark 173Y' of a single line having a large transmissivity is formed in the head transfer region 172Y of each of two YMC transfer region sets a and b, and identification marks 173M and 173C each of a single line having a small transmissivity are formed in the other transfer regions 172M and 172C of the same YMC transfer region set as shown in FIG. 13(A).

In the transfer sheet 170B in the example 2-16, an identification mark 173Y' of a single line having a large transmissivity is formed in the head transfer region 172Y of each of two YMC transfer region sets a and b, and identification marks 173M, 173C and 173OP each of a single line having a small transmissivity are formed in the other transfer regions 172M, 172C and 172OP of the same YMC transfer region set as shown in FIG. 13(B).

The transfer sheets 170A and 170B are subject to various changes and variations without departing from the scope of the present invention.

For example, different parts of an identification mark and different identification marks may differ from each other in electrical characteristics or magnetic characteristics.

The transfer sheet may additionally be provided with receiving regions.

Bar codes capable of representing a large number of pieces of information may be used as the identification mark.

The different identification marks (examples 2-9 to 2-16) may have a part of a characteristic different from that of the other part (examples 2-11 to 2-8).

As is apparent from the foregoing description, according to the present invention, the identification marks of the same form and each having a part of a characteristic different from that of the other part enable the detection of the transfer regions and are capable of representing an increased number of pieces of information. The YMC transfer region sets and the transfer regions can exactly be identified by the identification marks of different characteristics.

What is claimed is:

1. A method of manufacturing a transfer sheet comprising a base sheet, a thermal transfer layer having a plurality of transfer region sets, each transfer region set having a plurality of transfer regions with functions different from each other, and identification marks formed in the transfer region sets, said method comprising the steps of:

forming the thermal transfer layer having the plurality of transfer region sets on the base sheet by using a plurality of transfer region printing cylinders, each provided with a plurality of printing plates for printing the transfer regions of different functions; and forming the different identification marks in the transfer region sets.

2. The method according to claim 1, wherein the identification marks of one transfer region set are printed by using printing plates on a printing cylinder different from those for the other transfer region sets on the printing cylinder, and have forms different from those for the other transfer region sets.

3. The method according to claim 1, wherein the identification marks of one transfer region set, for each transfer region, are printed by using printing plates on a printing cylinder different from those for the other transfer region sets on the printing cylinder and have the same form, and the identification mark of one of the transfer regions of the transfer region set has a characteristic different from those for the identification marks of the other transfer regions of the same transfer region set.

4. The method according to claim 1, wherein the identification marks of one transfer region set are printed by using printing plates on a printing cylinder different from those for the other transfer region sets on the printing cylinder, and the identification marks of the transfer region set have characteristics different from those for the other transfer region sets.

5. A transfer printing method using a transfer sheet comprising a base sheet, a thermal transfer layer having a plurality of transfer region sets, each transfer region set having a plurality of transfer regions with functions different from each other, and identification marks formed in the transfer region sets, said method comprising the steps of:

recording information in the identification marks of the transfer region sets;

reading the identification marks of the transfer region sets, and correcting transfer conditions on the basis of the information represented by the identification marks, and transferring the transfer regions.

6. A transfer sheet comprising:

a base sheet;

a thermal transfer layer having a plurality of transfer region sets, each transfer region set having a plurality of transfer regions with functions different from each other; and identification marks formed in the transfer region sets, respectively;

wherein the identification marks formed in differing transfer region sets are different.

* * * * *